United States Patent [19]

Hudimac, Jr.

[11] 4,138,603

[45] Feb. 6, 1979

[54] OPERATOR FOR MICROSWITCHES

[75] Inventor: George S. Hudimac, Jr., Allentown, Pa.

[73] Assignee: Mechanical Service Co., Inc., Allentown, Pa.

[21] Appl. No.: 838,736

[22] Filed: Oct. 3, 1977

[51] Int. Cl.[2] ..... H01H 3/00

[52] U.S. Cl. ..... 200/153 T

[58] Field of Search ..... 200/153 T, 166, 153 V, 200/153 L, 153 LB, 52 R

[56] References Cited

U.S. PATENT DOCUMENTS

| | | | |
|---|---|---|---|
| 2,547,765 | 4/1951 | Lund | 200/172 A |
| 2,742,544 | 4/1956 | Lovick | 200/83 |
| 3,578,930 | 5/1971 | Tiefenthaler | 200/153 T |

*Primary Examiner*—George T. Hall

*Attorney, Agent, or Firm*—Frederick J. Olsson

[57] ABSTRACT

Plunger on a microswitch is provided with ball means arranged so that the ball means will move the plunger when contacted by a switch actuator moving in an axial direction or moving in any radial direction or combination of same.

10 Claims, 7 Drawing Figures

OPERATOR FOR MICROSWITCHES

This invention relates to electrical switches and in particular relates to improved means for operating microswitches employed in position control of relatively movable machine parts and the like.

Switches of the kind in question are normally used by mounting the switch on one part in juxta-position with an actuator mounted on the other part so that relative motion between the parts will actuate the switch. The contacts of the switch are manipulated by an axially movable plunger which is moved inwardly by the actuator and is moved out by an internal spring when the actuator disengages.

To accommodate the wide variety of directions and magnitudes of possible relative motions between the parts to be controlled, it is conventional to use both plain plunger type and plunger/roller type of switches. As to the latter, there are two types of switches, the difference being in the 90° orientation of the roller.

In general, plain plunger type switches are employed where the parts to be controlled are immediately stopped when the plunger is contacted and roller-plunger switches are employed when there is to be some over-travel after contact, the roller rotation accommodating this additional travel. The roller also reduces friction.

Any of the above switches can be mounted on one of the parts to be controlled in any horizontal/vertical orientation of the plunger axis so the same will be contacted by the actuator on the other part. This imposes a requirement for special or custom bracketing to meet the necessary orientation.

In order to have the capability of meeting all common design requirements, it is customary for those in the art such as machine tool builders and rebuilders, automation equipment builders and for in-house or independent control equipment fabricators and the like to carry or have readily available a relatively large inventory of the three types of switches and either to job-out or to employ designers and maintain fabricating facilities for bracketing.

With the above in mind then the principal object of this invention is to provide an adaptor or plunger operating means which enables switch inventory to be cut by two thirds and which eliminates the special bracketing situation while providing full capability of meeting all design requirements.

Preferred embodiments of the invention for both in-the-field and original equipment applications will be described below in connection with the following drawings wherein.

While the invention is presented in connection with microswitches it will be noted that the invention has application in nonswitch areas as will appear later on. Also, for ease of description the material which follows assumes that the switch is connected to a stationary part and that the actuator is connected to a moving part. It will be understood that in practice the actuator may be fixed and the switch connected to a moving part.

Figure 1:
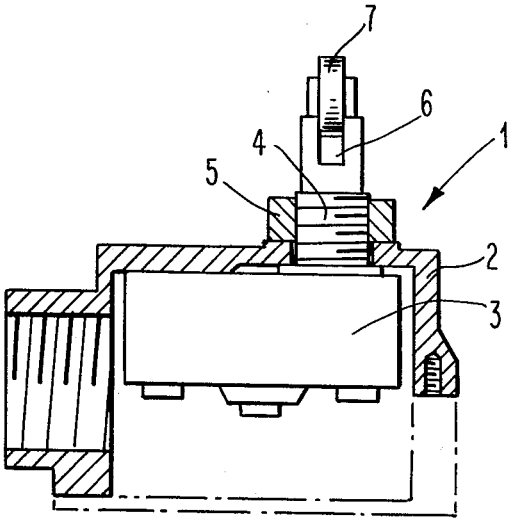
FIG. 1 is a side elevational view partially in section of a conventional microswitch with a roller/plunger arrangement.

In FIG. 1 a unit to be controlled such as the conventional microswitch 1 has a casing 2 mounting the switch contact housing 3 which has a threaded collar 4 extending thru and outwardly of the casing. A nut 5 threaded on the collar 4 secures the housing in position.

The contacts within the housing 3 are actuated by a movable control member or plunger 6 which is mounted for reciprocating axial motion within the collar 4. The plunger mounts a freely rotatably roller 7 the rotational axis of which lies in the plane of the paper. The roller is adapted to be contacted by a switch actuator moving in a direction normal to the plane of the paper. Upon such contact the roller will rotate and also move the plunger inwardly to operate the contacts. When the switch actuator disengages, an internal spring moves the plunger out to the normal position as shown.

Another type of standard conventional microswitch has the same construction as described above except that the roller is mounted with its axis 90° to the roller 7, i.e. with the rotational axis perpendicular to the plane of the paper.

Figure 2:
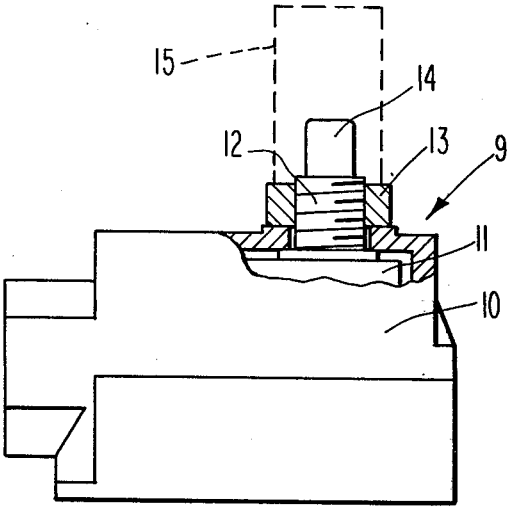
FIG. 2 is a side elevational view of a conventional microswitch having a plain plunger.

Still another type of conventional microswitch is shown in FIG. 2. The construction of switch 9 is the same as that described above except for the plunger. The casing 10 mounts the housing 11, the collar 12 of which extends outwardly thru the casing. The nut 13 is threaded on the collar holds the housing and casing together. The plunger 14 is mounted for reciprocating motion in the collar. As noted, the plunger is plain or without a roller.

For purposes of the roller 7 or plunger 14 being contacted by a switch actuator, it is conventional to orient the switch in some desired horizontal or vertical position or some combination of same. This is accomplished by designing and fabricating the special brackets.

To meet the various and diverse requirements commonly appearing in the art, it is necessary to inventory the above described three types of switches and provide for special bracket fabrication.

In contrast to the switch inventory and bracket system, the present invention contemplates a single unit adapted to accommodate any of the movements common to the art and to provide this without the use of special brackets.

In one aspect the invention contemplates an arrangement comprising as adaptor which will permit installers or users such as machine tool builders, etc. to purchase a conventional plain plunger type switch only and then combine with the adaptor to make a universally useable unit.

In another aspect the invention contemplates an arrangement for modifying the plunger of a conventional plain type plunger which can be effected by switch manufacturers to provide a single universally useable unit.

With the above in mind, the in-the-field and original equipment arrangements will now be described, in-the-field arrangement being treated first.

Referring to FIG. 2, the user of the in-the-field arrangement simply removes the nut 13 of the switch 9 and replaces the same with an adaptor as indicated by the dotted lines 15. This produces the universally useable unit.

Figure 3:
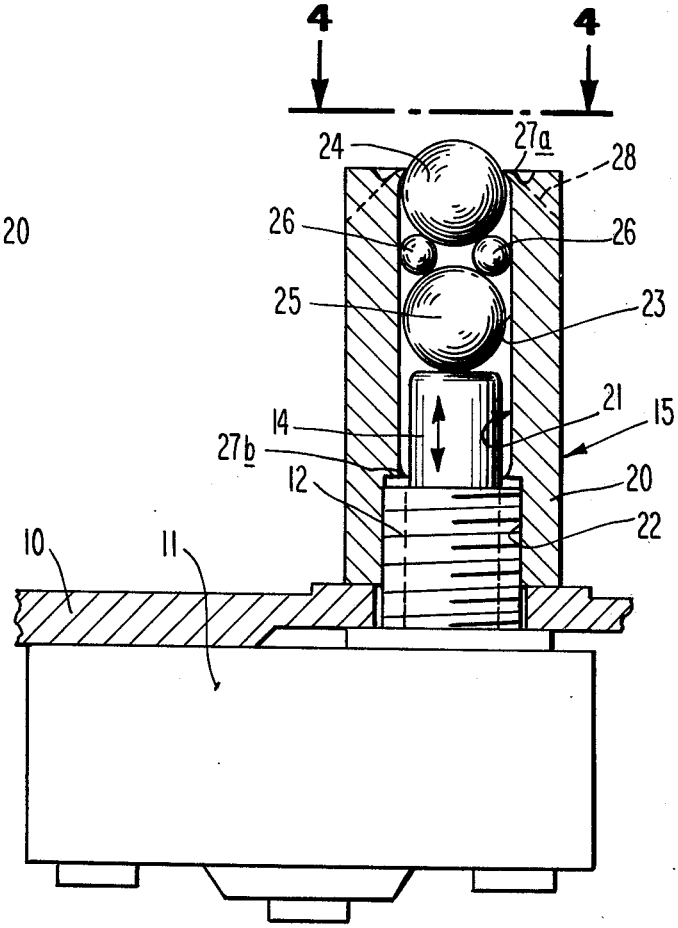
FIG. 3 is an enlarged fragmentary view of the adaptor of the invention for in-the-field applications.

A preferred arrangement for the adaptor 15 is shown in detail in FIG. 3.

The adaptor includes the elongated body 20 which has an axially extending open-ended bore 21, including a lower or first section 22 having threads mating with the threads on the collar 12. The bore 21 also has a second or upper section 23 which is nonthreaded. The body 20 functions like the nut 13 in that when the same is tightened up the housing 11 and casing 10 are secured together. For such purposes the body 20 is hexagonal for easy tightening with a wrench.

Within the section 23 are a pair of spaced apart balls 24 and 25 and within the space are disposed the intermediate balls 26 which are usually 4 in number. The lower ball 26 is disposed on top of the plunger 14.

Figure 4:
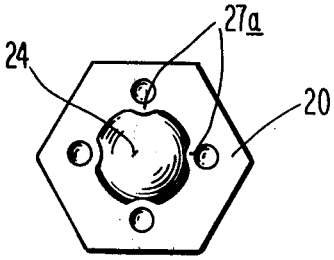
FIG. 4 is a top view taken along the lines 4—4 of FIG. 3.

At the upper and lower ends of the section 23 are a plurality of abutments **27*a* and 27*b* typically formed by peened over areas. Preferably there are 4 of such peened over areas equally spaced around the axis of the bore as best noted for the areas 27*a* in FIG. 4**. The abutments retain the balls in the bore.

The dimensions of the various parts of the adaptor are coordinated with the location of the top of the plunger (in its fully outmost position) so that when the body 20 is secured tightly on the threads the balls are retained between the top of the plunger 14 and the abutments **27*a*** with a slight axial play which is preferably not over 1/64 inches. Some play is desirable so that tolerences can be within economically acceptable limits.

Also, the dimensions of the section 23 and the diameters of the balls are made so that the balls are freely universally rotatable and movable axially within the section.

It will be observed that the upper ball 24 extends outwardly of the body 20. This permits the ball to be engaged by a switch actuator. If the switch actuator moves in a direction along the axis of the bore 21 it will contact the ball 24 which in turn will move the balls 25 and 26 downwardly and the plunger 14 will be moved inwardly. When the switch contactor is disengaged the internal spring will return the plunger to the position shown. If the switch actuator moves radially or in a direction transverse the axis of the bore 21 it will contact the ball 24 and effect the same down motion of the plunger. Moreover, it will be appreciated that the switch actuator can move along any radius throughout 360° and in doing so will engage the ball.

The structure which provides for the ball to be engaged when the switch actuator moves axially or along any radius with respect to the bore 21 provides for the unit to be used both in the immediate stop applications and in the overtravel applications. Moreover, no special brackets are required to position the unit for the various radial direction engagements. The unit may be conveniently employed where the actuator motion is radial and at an angle to the bore axis. To widen the range of the range of the latter applications, the top of the adaptor may be chamfered as indicated at 28.

The arrangement of the balls 24, 25 and 26 as shown is highly advantageous in that it provides for point contact between the balls and between the balls and the sides of the bore 21 and between the balls and the abutments 27. This minimizes friction and enhances the free rotation of the balls.

Smooth, free rotation is important from the standpoint of smooth positive non-erratic operation so that there is very low backthrust on the switch actuator.

In view of the foregoing description it will be apparent that from the standpoint of field use, it is only necessary to inventory switch as of the kind shown in FIG. 2 along with adaptors and this provides for a combination which is adaptable for use throughout the whole spectrum of possible applications both for axial and radial motions of the switch actuator. The conventional inventory and special bracketing problems are eliminated.

In conventional microswitches, very small axial motion of the plunger is required to operate the switch contacts and in some equipment the switch and adaptor may be mounted on a part subject to severe vibration or sudden movement in a direction along the axis of the bore 21. To avoid accidental operation of the contacts, the adaptor may be provided with a spring to bias the balls 24, 25 and 26 against the abutments 27. A compression spring is disposed in the upper section 23 surrounding the plunger 14 and with its lower and on the collar 12 and its upper end engaging the ball 25.

Figure 5:
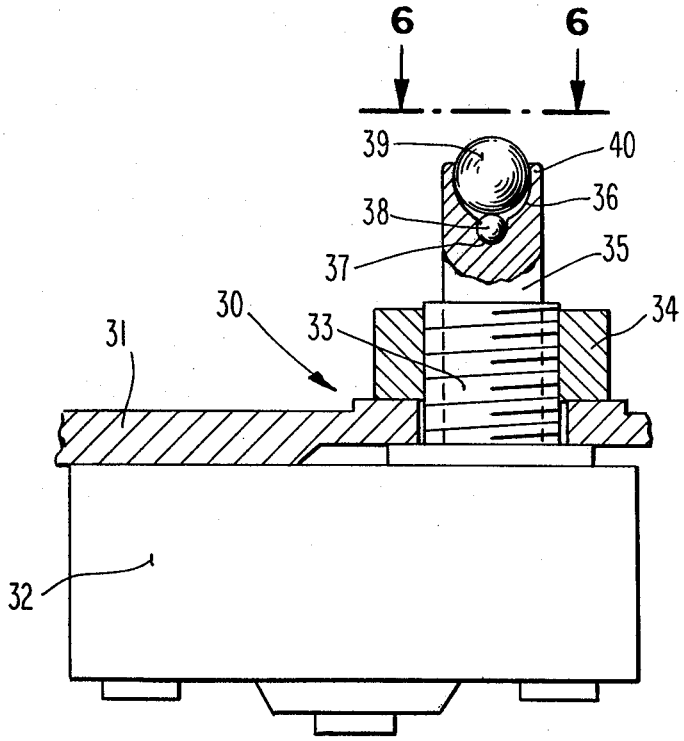
FIG. 5 is an enlarged fragmentary view of an original equipment arrangement of the invention.

In FIG. 5 I have illustrated a typical original equipment arrangement. In this arrangement the invention contemplates modifying the plunger to obtain the same functions as the combined switch/adaptor unit described above.

The switch 30 has a casing 31 which mounts the contact housing 32. The threaded collar 33 on the housing carries the nut 34. The plunger is mounted in the collar for reciprocating motion.

Figure 6:
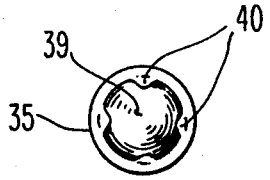
FIG. 6 is a view taken along the lines 6—6 of FIG. 5.

The plunger has a cavity 36 and at the bottom of the cavity is a bore 37. The bore 37 carries at least one ball 38 which is rotatably mounted therein and extends slightly into the cavity 36. The cavity 36 carries a ball 39. The top of the cavity is peened over at 40 preferably at 4 places as noted in FIG. 6. The peened over areas form abutments and maintain the balls in the cavity.

The above arrangement provides for substantial point contacts between the balls 38 and 39 and between the balls and engaging portions of the plunger so as to enhance the free rotation and minimize friction.

Figure 7:
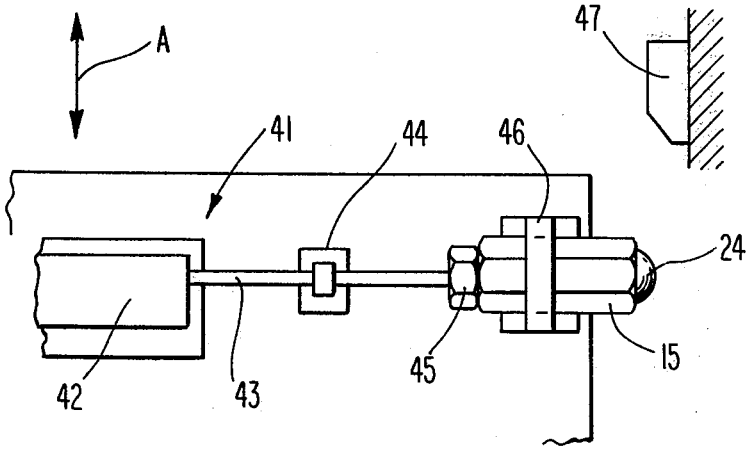
FIG. 7 is an elevational view showing the adaptor of the invention applied in a non-switch type application.

In FIG. 7 I have diagramatically illustrated how the adaptor may be employed in a non-switch type application.

A fixture 41 is to move back and forth in the direction of the arrows A. The fixture carries the adaptor 15 and a unit 42 to be controlled, for example, to be operated at a specified interval as the fixture moves. The unit may include, for example, a pair of jaws that are opened and closed.

The unit 42 is operated by a shaft or movable control member 43 mounted on the fixture 41 by the bearing means 44 for both rotational and axial motion. The end of the shaft is threaded into the adaptor 15. The adaptor and shaft are secured together by nut 45. The adaptor is secured to fixture 42 by clamp 46.

A cam or actuator 47 is fixed with respect to the fixture 41 in a position to be contacted by the ball 24 of the adaptor. Upon contact with the cam ball moves the shaft 43 axially and this causes operation of the jaws. The shaft 43 is spring loaded so that when the fixture moves to disengage the cam and ball the shaft and adaptor will move out to the position shown.

In mechanical arrangements of the kind being discussed it is necessary to frequently rotate the position of the unit to be controlled. It will be self evident that the adaptor conveniently permits such adjustment without effecting the operation of the ball and cam.

A plain plunger type of switch could not, from a practical standpoint, be employed in the above arrangement because of the friction and back thrust which would be generated between plunger and cam. A roller/plunger type switch would not be practical in as much as rotational adjustment would result in the roller skidding over the cam.

I claim:

1. An adaptor for use in operating the plunger of an electrical switch comprising:

an elongated body;

an axial, open-ended bore extending thru the body and having a first threaded section extending from one open end toward the center and also having a second, non-threaded section extending from the other open end toward the center, said threads being for use in mounting the adaptor on a switch and the second section being for use in receiving the plunger on the switch;

a plurality of abutments at the open end of said second section;

first and second balls spaced apart and rotatably and axially movably mounted in said second section, the first ball engaging said abutments whereby to be retained in the section and a portion of the first ball extending outwardly of the body so as to be engageable by a switch actuator and the second ball being for use in engaging the plunger of the switch; and a plurality of intermediate balls rotatably and axially movably mounted in the space between the first and second balls and respectively engaging the same.

2. The adaptor of claim 1 furhter including a plurality of abutments at the inner end of said second section for retaining the balls in the section.

3. An adpator for use in operating a movable control member on a unit to be controlled, the adaptor comprising;

an elongated body;

an axial, open-ended bore extending thru the body and having a first threaded section extending from one open end toward the center and also having a second, non-threaded section extending from the other open end toward the center, said threads being for use in mounting the adaptor on a unit to be controlled and the second section being for use in receiving the movable control member on the unit;

a plurality of abutments at the open end of said second section;

first and second balls spaced apart and rotatably and axially movably mounted in said second section, the first ball engaging said abutments whereby to be retained in the section and a portion of the first ball extending outwardly of the body as as to be engagable by an actuator and the second ball being for use in engaging the movable control member on the unit to be controlled; and a plurality of intermediate balls rotatably and axially movably mounted in the space between the first and second balls and respectively engaging the same.

4. The adaptor of claim 3 further including a plurality of abutments at the inner end of said second section for retaining the balls in the section.

5. An adaptor for use in operating a movable control member on a unit to be controlled, the adaptor comprising;

an elongated body;

an axial, open-ended bore extending thru the body and having a first section extending from one open end toward the center and also having a second section extending from the other open end toward the center;

means on said body for mounting the same on the unit to be controlled and said second section being for use in receiving the movable control member on the unit;

a plurality of abutments at the open end of said second section;

first and second balls spaced apart and rotatably and axially movably mounted in said second section, the first ball engaging said abutments whereby to be retained in the section and a portion of the first ball extending outwardly of the body so as to be engagable by an actuator and the second ball being for use in engaging the movable control member on the unit to be controlled; and a plurality of intermediate balls rotatably and axially movably mounted in the space between the first and second balls and respectively engaging the same.

6. The adaptor of claim 5 further including a plurality of abutments at the inner end of said second section for retaining the balls in the section.

7. In combination:

an electrical switch and an adaptor for operating the switch;

said switch having a casing, a housing inside the casing mounting switch contacts, threaded collar means on the housing extending thru and outwardly of the casing and a plunger mounted in the collar for reciprocating axial motion for actuating the contacts;

said adaptor comprising:

(a) an elongated body;

(b) an axial, open-ended bore extending thru the body and having a first threaded section threaded on said collar and causing the housing and the casing to be tightly engaged and also having a second section receiving said plunger;

(c) a plurality of abutments at the open end of said second section;

(d) first ball rotatably and axially movably mounted in said second section, the first ball engaging said abutments thereby to be retained in the section and a portion of the first ball extending outwardly of the body so as to be engagable by a switch actuator;

(e) a second ball rotatably and axially movably mounted in said second section adjacent the end of said plunger and axially spaced from the first ball; and (f) a plurality of intermediate balls rotatably and axially movably mounted in said second section in the space between the first and second balls and in contact therewith.

8. The adaptor of claim 7 further including a plurality of abutments at the inner end of said second section for retaining the balls in the section.

9. In an electrical switch of the type having a housing for the switch contacts and means on the housing supporting a plunger for reciprocating axial motion for actuating the contacts, the improvement which comprises:

a ball; and means mounting the ball on the plunger for universal rotation with respect thereto and with a portion of the ball extending outwardly from the plunger so as to be engagable by a switch actuator and said means providing, as a function of the contact between ball and actuator, for the ball to move the plunger while the ball is in a non-rotary condition and for the ball to move the plunger while in rotary condition.

10. The combination of claim 9 wherein said means includes a cavity in the plunger, a bore at the bottom of the cavity, at least one second ball in the bore and extending into the cavity, first said ball being disposed in the cavity and engaging the second ball and peened over areas at the mouth of the cavity engaging and retaining the balls in the plunger.

* * * * *